US010204634B2

(12) United States Patent
Tada et al.

(10) Patent No.: US 10,204,634 B2
(45) Date of Patent: Feb. 12, 2019

(54) DISTRIBUTED SUPPRESSION OR ENHANCEMENT OF AUDIO FEATURES

(71) Applicant: Cisco Technology, Inc., San Jose, CA (US)

(72) Inventors: Fred M. Tada, Belmont, CA (US); Pascal H. Huart, Maisons Laffitte (FR)

(73) Assignee: Cisco Technology, Inc., San Jose, CA (US)

( * ) Notice: Subject to any disclaimer, the term of this patent is extended or adjusted under 35 U.S.C. 154(b) by 282 days.

(21) Appl. No.: 15/084,909

(22) Filed: Mar. 30, 2016

(65) Prior Publication Data

US 2017/0287495 A1 Oct. 5, 2017

(51) Int. Cl.

| | |
|---|---|
| ***G10L 21/00*** | (2013.01) |
| ***G10L 19/16*** | (2013.01) |
| ***G10L 21/0208*** | (2013.01) |
| *G10L 21/02* | (2013.01) |
| *G10L 25/48* | (2013.01) |

(52) U.S. Cl.

CPC ..... *G10L 19/167* (2013.01); *G10L 21/02* (2013.01); *G10L 21/0208* (2013.01); *G10L 21/0205* (2013.01); *G10L 25/48* (2013.01)

(58) Field of Classification Search

CPC combination set(s) only.

See application file for complete search history.

(56) References Cited

U.S. PATENT DOCUMENTS

| | | | | |
|---|---|---|---|---|
| 6,462,264 | B1 | 10/2002 | Elam | |
| 7,502,735 | B2 * | 3/2009 | Ehara | G10L 19/005 704/228 |
| 8,116,236 | B2 * | 2/2012 | Baird | H04L 65/607 370/260 |
| 9,691,378 | B1 * | 6/2017 | Meyers | G10L 15/08 |
| 2006/0100868 | A1 * | 5/2006 | Hetherington | G10L 21/0208 704/226 |

OTHER PUBLICATIONS

Ivov, et al., "A Real-Time Transport Protocol (RTP) Header Extension for Mixer-to-Client Audio Level Indication," Internet Engineering Task Force (IETF), Request for Comments: 6465, Category: Standards Track, Dec. 2011, p. 1-15.

* cited by examiner

*Primary Examiner* — Vu B Hang

(74) *Attorney, Agent, or Firm* — Edell, Shapiro & Finnan, LLC

(57) ABSTRACT

Techniques are provided in which an audio signal for transmission to a receiving device is acquired at a network device. The audio signal is analyzed for an audio feature to be suppressed or enhanced during playback of the audio signal at the receiving device. The audio feature is detected based on the analysis. The audio signal is encoded for transmission over a network to the receiving device. The encoded audio signal is transmitted to the receiving device. A packet is generated comprising an audio feature descriptor indicating where in the audio signal the audio feature is located to enable the receiving device to suppress or enhance the audio feature during playback of the audio signal. The packet comprising the audio feature descriptor is transmitted to the receiving device.

20 Claims, 12 Drawing Sheets

KN "KEY NOISE"
Ts START TIME OFFSET
Td DURATION
MAG MAGNITUDE IN DBFS

KN "KEY NOISE"
Ts START TIME OFFSET
CI CODEBOOK INDEX

DISTRIBUTED SUPPRESSION OR ENHANCEMENT OF AUDIO FEATURES

TECHNICAL FIELD

The present disclosure relates to the modification of audio signals, and in particular, the distributed suppression or enhancement of audio features.

BACKGROUND

Telephony devices such as desktop or handheld phones may introduce undesirable sounds from their microphones into voice calls. Far end listeners may be subjected to clicking, tapping, or scraping sounds as a device is manipulated. The environment in which a desktop or handheld phone is located may also introduce undesirable sounds into voice calls. For example, wind noise or background voices may be introduced into voice calls.

DESCRIPTION OF EXAMPLE EMBODIMENTS

Overview

In one embodiment, a method is provided in which an audio signal for transmission to a receiving device is acquired at a network device. The audio signal is analyzed for an audio feature to be suppressed or enhanced during playback of the audio signal at the receiving device. The audio feature is detected based on the analysis. The audio signal is encoded for transmission over a network to the receiving device. The encoded audio signal is transmitted to the receiving device. A packet is generated comprising an audio feature descriptor indicating where in the audio signal the audio feature is located to enable the receiving device to suppress or enhance the audio feature during playback of the audio signal. The packet comprising the audio feature descriptor is transmitted to the receiving device.

Also provided is a method in which a first packet comprising audio data of an audio signal is received at a network device. A second packet comprising an audio feature descriptor indicating an audio feature in the audio signal that is to be suppressed or enhanced during playback of the audio signal is received at the network device. The audio feature is detected in the audio data based upon the audio feature descriptor. The audio feature is suppressed or enhanced during playback of the audio signal.

EXAMPLE EMBODIMENTS

Figure 1:
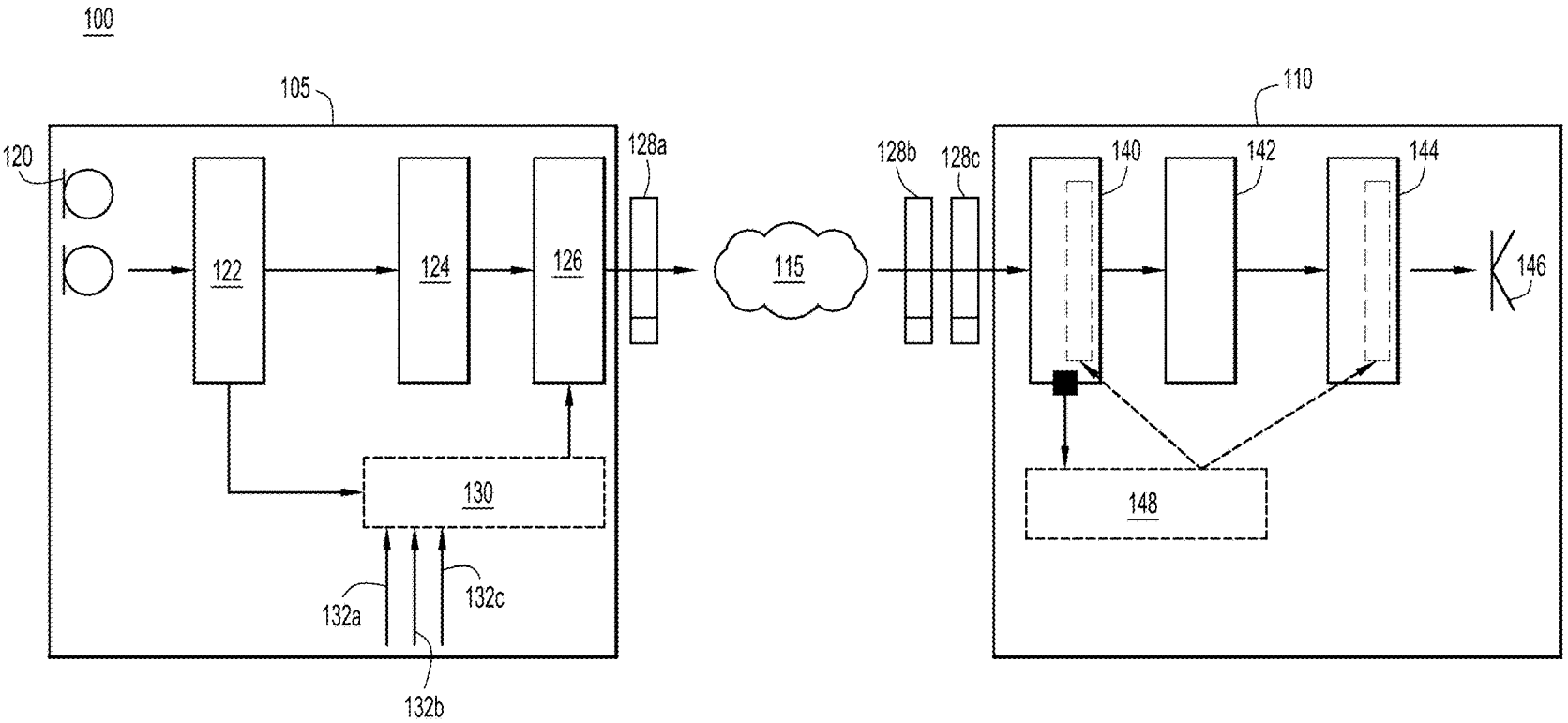
FIG. 1 is a block diagram of a network environment configured to provide distributed suppression or enhancement of audio features, according to an example embodiment.

With reference first to FIG. 1, depicted therein is a network environment 100 in which network devices 105 and 110 are configured to provide distributed suppression or enhancement of audio features in audio data transmitted through a transmission path that includes network 115. For example, device 105 and device 110 may be facilitating a Voice over Internet Protocol (VoIP) telephone conversation and/or an online collaborative session, such as a video conference, between the respective users of the devices. The example of FIG. 1 assumes that device 105 is a transmitting device and device 110 is a receiving device, though in real-world embodiments, each side of the transmission path through network 115 may include both transmitting and receiving capabilities.

Included in transmitting device 105 are microphones 120, transmitter audio processing module 122, audio encoder 124 and packetizer 126. Audio signals detected by microphones 120 are transmitted to transmitter audio processing module 122 where initial audio processing, such as microphone processing and echo cancellation, is performed on the received signal. The signal is passed from transmitter audio processing module 122 to audio encoder 124 where the signal is encoded according to, for example, the G.723.1, G.711a, G.711u, G.729a, G.722, AMR-WB, AAC-LD, and Opus codecs. Once encoded, the encoded data is sent to packetizer 126, where the encoded data is packetized and transmitted as packets 128*a-c* to receiving device 110.

As used herein, the transmitting device may be embodied in a single device as illustrated or in a plurality of devices, with different devices serving to, for example, acquire the audio signal via microphones 120, while one or more other devices provide the transmitter audio processing module 122, audio encoder 124 and packetizer 126. The plurality of devices may be connected electrically, optically, wirelessly, or otherwise, to permit the operation as described herein. Similarly, the different functions of the receiving device 110 may be split into separate physical devices.

Also included in transmitting device 105 is audio feature detector 130. Audio feature detector 130 also receives the audio signal from transmitter audio processing module 122 so that it may examine the audio features of the signal to determine whether or not desired or undesired audio features are present therein. An audio feature is a property, condition, or event embedded in an audio stream. Audio features may indicate desired or undesired components, such as background noise and speech, where the background noise is undesired and the speech is desired. Audio features may be used to enhance an audio stream by suppressing undesired audio features or improving desired audio features. Accordingly, audio feature detector 130 emits descriptors that identify signal characteristics and/or relevant metadata associated with audio features. The descriptors may then be used to locate and suppress, eliminate or enhance the audio features indicated by the descriptor. For example, audio feature descriptors may be analyzed at receiving device 110 to locate transient noise within an audio signal, and subsequent suppression of the transient noise at receiving device 110. According to another example, two voices may be detected in an audio signal, both of which represent users participating in a VoIP and/or teleconference call. The user associated with a first of the voices is closer to microphones 120 while the user associated with a second of the two voices is further from microphones 120. Because of the difference in distance, the first voice is louder than the second voice. The system of FIG. 1 may need to adjust the two voices to the same level as the two users alternately speak. An audio feature descriptor may be emitted by audio feature detector 130 that signals to receiving device 110 the desired adjustment to the volume level for sections of the audio signal associated with each of the two voices.

The descriptors generated by audio feature detector 130 may fall into different categories of descriptors, such as signal characteristic descriptors, usage descriptors and/or environmental descriptors. Signal characteristic descriptors may include parameters such as signal classification, temporal boundaries, signal metrics, and waveform identifiers. Usage descriptors may include information such as a mode of use (e.g., hands free or speaker phone operation) of a transmitting device, or the type of device that serves as the transmitting device (e.g., a mobile handset, a headset, a speaker phone, etc.). Usage descriptors may also include indications of motion of the transmitting device, active transducers of the transmitting device, or a physical orientation of the transmitting device. Environment descriptors may include information such as whether the transmitting device 105 is located indoors or outdoors, whether transmitting device 105 is utilized within a vehicle, or whether the transmitting device 105 is servicing multiple users. The data contained in these descriptors may be determined based on cameras, accelerometers, global positioning sensors, Internet Protocol address location services, and others.

As used herein, a transient sound refers to an audio feature that is not intended to be transmitted to and/or played back by receiving device 110. Transient sounds include, for example, keyboard or mobile device key tap or press sounds, touch screen tap sounds, the sounds of a dropped device, or others known to those skilled in the art. As will be described in more detail below, audio feature detector 130 may analyze the audio signal for transient sounds by targeting both generic and device specific sound patterns by methods including signal discrimination, spectrum analysis, correlation, and machine learning. If candidate transient sounds are detected, audio feature detector 130 records data such as the magnitude and temporal boundaries of the candidate events.

Some transient sounds such as key presses, touch screen taps, and/or device drops may generate associated system events in addition to sounds. For example, the system actions taken in response to a key press, a touch screen tap or an accelerometer reading associated with a device drop may be registered by a transmitting device, such as transmitting device 105. According to the techniques described herein, these system events may be correlated with the audio signal provided to audio feature detector 130 by transmitter audio processing module 122. In order to perform this correlation, audio feature detector 130 may receive data corresponding to system events, as illustrated through reference numerals 132*a-c*.

If audio features associated with transient sounds are detected by audio feature detector 130, steps will be taken to ensure that the transient sounds are not transmitted and/or played back by receiving device 110. The detected audio feature may be eliminated at transmitting device 105 before transmission of the audio signal to receiving device 110. Or, as will be described in greater detail below, audio feature detector 130 may translate the detected audio feature into a descriptor that is transmitted to receiving device 110. The audio feature descriptor may provide an indication of where the audio feature associated with the transient sound is located within the audio signal. Receiving device 110 may then perform the role of eliminating or enhancing the transient sound from the playback of the audio signal based upon data in the audio feature descriptor.

System events associated with certain audio features are delayed (i.e., have latencies) relative to sound data associated with the audio feature. Events such as key de-bounce, touch panel de-noising/signaling, and accelerometer or sensor data exhibit such latencies. These system events may be delayed such that the audio samples containing the audio feature associated with the system event may have already been compressed, packetized, or transmitted from transmitting device 105 to receiving device 110. The analysis of the audio signal to locate audio features may also introduce latencies. For example, by the time the audio signal is analyzed and an audio feature is detected at audio feature detector 130, audio encoder 124 and packetizer 126 may have already completed their respective functions, and the packets associated with the audio feature may have already started to be transmitted. This may be true in signal processing in both the time domain and/or the frequency domain.

If the audio feature associated with the system event has not been encoded and/or packetized, it can be suppressed or enhanced at transmitting device 105. If the audio sample has already been packetized and/or transmitted, the audio feature information is incorporated into an audio feature descriptor and transmitted in an audio packet or alternate packet type. In other words, the audio feature descriptor may be included in the data stream that makes up the audio signal, in an in-band packet that does not contain data associated with the audio signal, and/or an out-of-band packet transmitted to receiving device 110 via the same or a different transmission path than that utilized by the packets associated with the audio signal.

It may be beneficial to send an audio feature descriptor to receiving device 110 to allow receiving device 110 to suppress or enhance the audio feature because delaying audio samples to match latencies (e.g., latencies associated with system events that give rise to the audio features) at transmitting device 105 is undesirable for real time interactive communications. Furthermore, detection is enhanced if signal analysis is combined with system events. Therefore, both accuracy and user experience benefits may be achieved by sending audio feature descriptors to receiving device 110, as opposed to delaying audio transmission in order to suppress or enhance audio features at transmitting device 105.

Audio feature descriptors may include incorporating information indicating the location and type of audio feature (e.g., the type of transient sound) in the audio signal into a Real-time Transport Protocol (RTP) header extension. The RTP header extension may include information sufficient for receiving device 110 to locate and suppress or enhance the audio feature indicated in the RTP header extension during the playback of the audio signal. The RTP header extension may be included in one or more of packets 128*a-c* which are transmitted from transmitting device 105, through a transmission path that may include network 115, to receiving device 110. The audio feature descriptor embodied in the RTP extension header may be transmitted in the same packet that includes encoded audio data associated with the audio feature, or in a different packet. For example, the audio feature descriptor may be included in an RTP header of a packet sent subsequent to the packet that contains the encoded audio data associated with the audio feature indicated in the audio feature descriptor.

Once packets 128*a-c* are received at receiving device 110, jitter buffer 140 un-encapsulates the encoded audio data, buffers the audio data according to jitter management policy, and passes the encoded audio data to audio decoder 142. The encoded data is decoded by audio decoder 142, and the decoded audio signal is passed to receiver audio processing module 144. After processing, the audio signal is played back over speaker 146.

If the audio features detected by audio feature detector 130 were previously removed and/or enhanced by transmitting device 105, no associated audio feature descriptor is emitted by transmitting device 105, and no audio feature related processing needs to take place at receiving device 110. On the other hand, receiving device 110 also includes receiver audio feature extractor 148. Audio feature extractor 148 receives the audio feature descriptors sent through packets 128*a-c*. Based on these audio feature descriptors, audio feature extractor 148 may identify and cause one or more of jitter buffer 140 and/or receiver audio processing unit 144 to suppress or enhance the audio feature identified in the audio feature descriptor.

Figure 2:
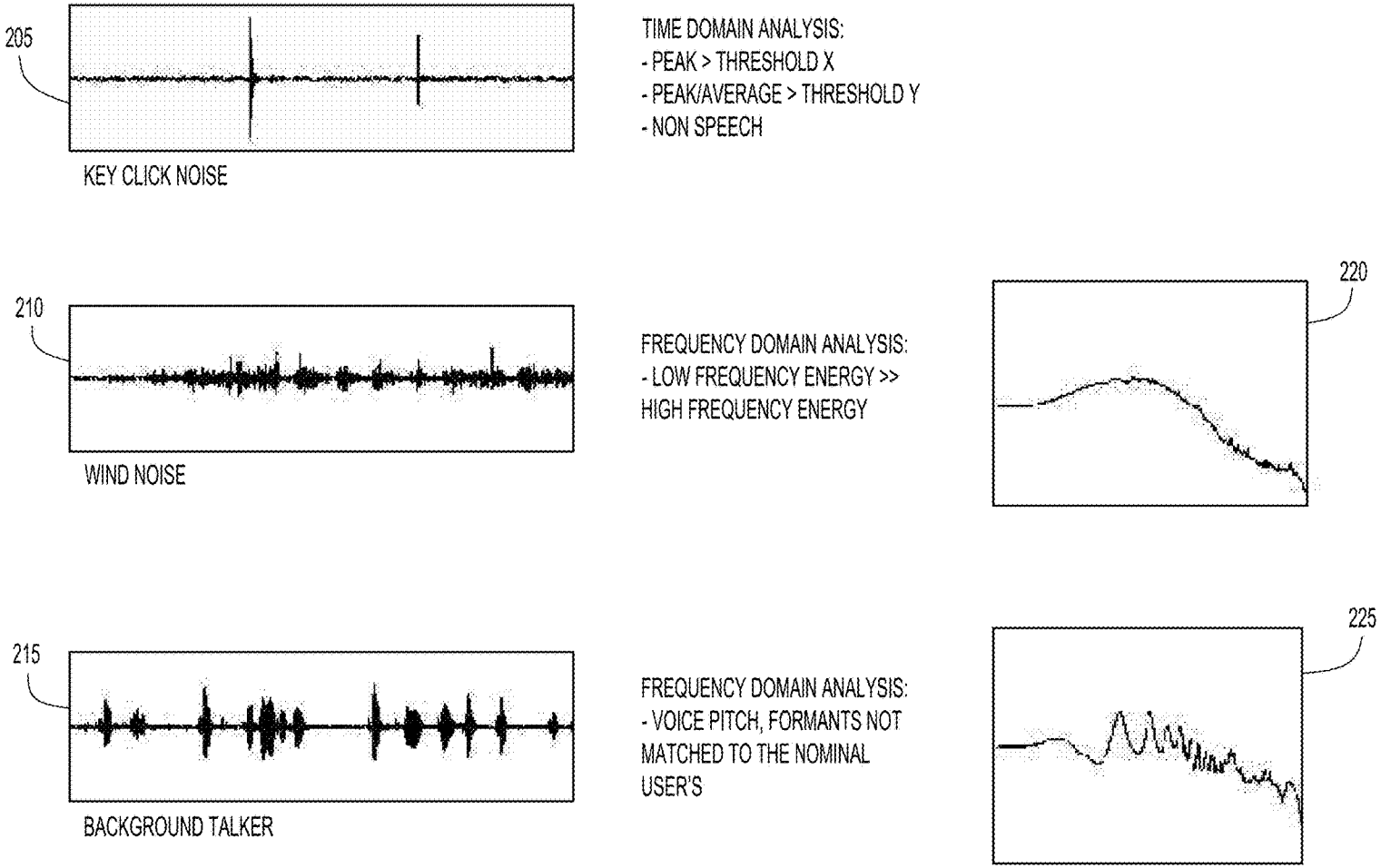
FIG. 2 is an illustration of audio signal analysis techniques used to provide distributed suppression or enhancement of audio features, according to example embodiments.

With reference now made to FIG. 2, depicted therein are illustrations of three time domain audio signals of example audio features 205, 210 and 215, and examples of different ways in which it may be determined which type of audio feature corresponds to the time domain audio signals. Specifically, audio signal 205 corresponds to a key click audio feature, audio signal 210 corresponds to a wind noise audio feature, and audio signal 215 corresponds to a background talker audio feature. Each of these audio signals may be analyzed in the time domain and/or the frequency domain to determine if they correspond to a particular audio feature. For example, a time domain analysis may determine that the click noise audio signal 205 is a click noise signal through a determination that its peak value is greater than a first predetermined threshold "X," that its peak threshold divided by its average threshold is greater than a second predetermined threshold "Y," and that its time domain signal indicates a non-speech signal pattern.

By converting audio signal 210 to the frequency domain, it may be determined that audio signal 210 corresponds to a wind noise audio feature. As illustrated in frequency domain audio signal 220, the frequency response matches known characteristics of a microphone subjected to wind noise. For example, a wind noise audio feature may be characterized by a signal that contains low frequency energy that is significantly greater than its high frequency energy. Such frequency domain analysis serves to identify audio signal 210 as corresponding to a wind noise audio feature.

By converting audio signal 215 to the frequency domain, it may be determined that audio signal 215 corresponds to a background talker audio feature. For example, in the frequency domain, it may be seen that the pitch and formant frequencies of the audio signal do not match those of the nominal user of the transmitting device. Accordingly, it may be determined that audio signal 215 corresponds to the noise of someone not participating in the VoIP call or online collaborative session being transmitted by the transmitting device, and therefore, audio signal 215 corresponds to a background talker.

Figure 3:
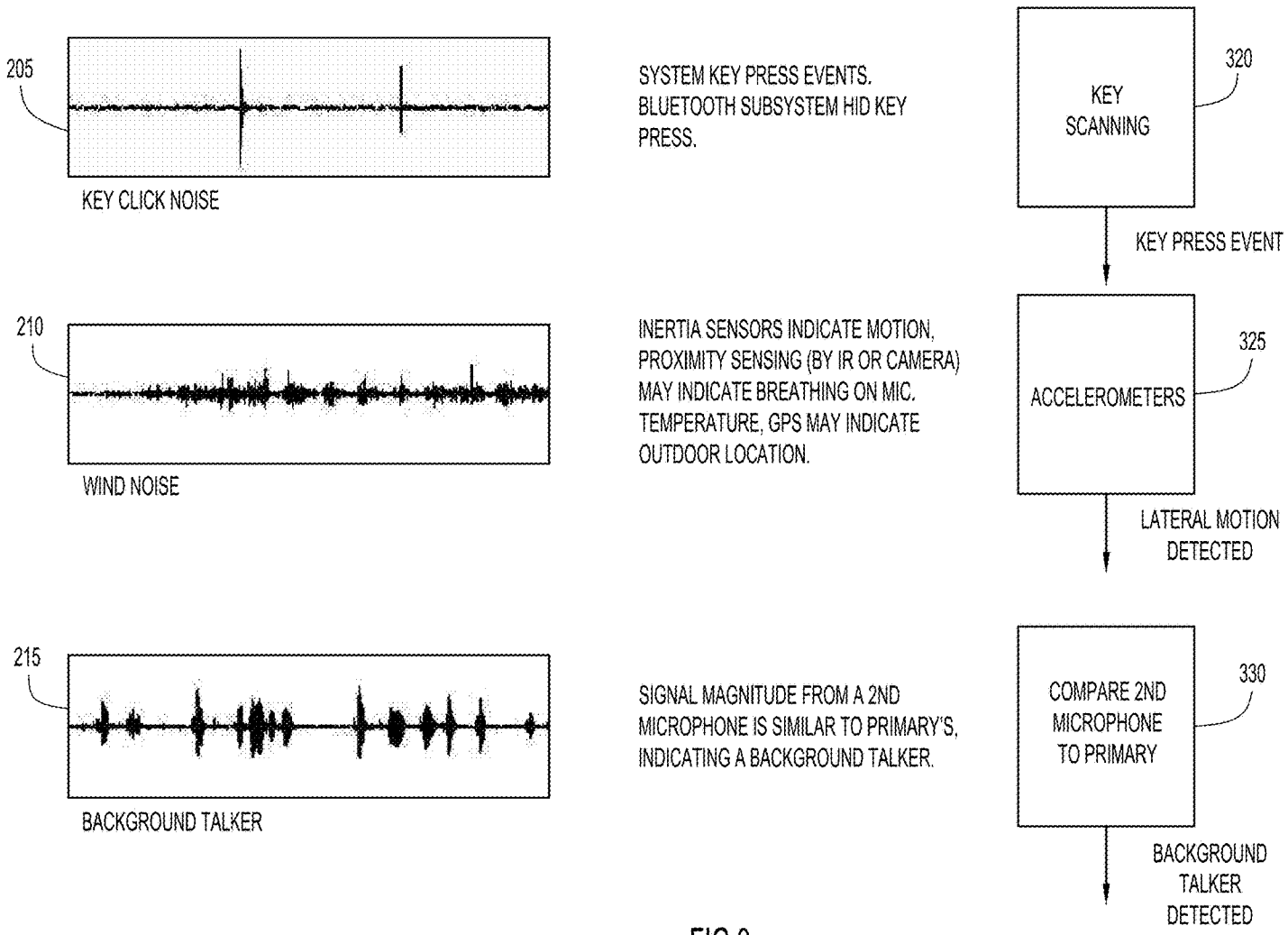
FIG. 3 is an illustration of supplemental information to provide distributed suppression or enhancement of audio features, according to example embodiments.

With reference now made to FIG. 3, depicted therein are illustrations of the three time domain audio signals of example audio features 205, 210 and 215 from FIG. 2. Specifically, audio signal 205 corresponds to a key click audio feature, signal 210 corresponds to a wind noise audio feature, and signal 215 corresponds to a background talker audio feature. Also illustrated in FIG. 3 is auxiliary information or system events 320, 325 and 330 that may be used alternatively or in conjunction with the signal analysis techniques described above with reference to FIG. 2 to determine the type of audio feature associated with audio signals 205, 210 and 215. Analysis of audio streams for audio feature detection can provide accurate timing information but may also generate false positives when the microphone is exposed to a wide range of similar sounds. For example, a speech plosive (i.e., an oral occlusive or stop consonant) may be incorrectly detected as a key click sound if only the audio data of the audio signal is taken into consideration. By correlating the detected sound with system events it may be determined that the oral plosive should not be suppressed. Specifically, because there is no key click system event that corresponds with the oral plosive, the oral plosive may be correctly determined to not be a key click sound, and therefore, should not be suppressed during playback at the receiving device. Accordingly, correlating signal analysis with auxiliary information 320, 325 and 330, may provide improved audio feature detection that accurately locates audio features while preventing false positives.

Key scanning processes 320 may be correlated with audio signals to locate corresponding key click events in audio signals. The key scanning processes may include system key press events and/or Bluetooth Human Interface Device (HID) key press events.

Sensor data 325 may be used to identify audio signal 210 as corresponding to a wind noise audio feature. For example, inertial sensors may indicate motion that may be accompanied by wind noise. Proximity sensor data (e.g., infrared sensors or a camera) may indicate proximity to a user, and therefore, may be correlated with wind noise caused by the user breathing on a microphone. Temperature sensors and/or Global Position System (GPS) sensors may indicate an outdoor location that is more likely to experience wind noise.

Secondary microphone data 330 may be used to identify audio signal 215 as corresponding to a background talker.

Specifically, data or signals from two different microphones may be compared to determine if the audio signal is coming from a primary or background talker. For example, if the signal magnitude received from a secondary microphone is similar to that of the primary microphone, this may serve as an indication that the signal is associated with a background talker. Otherwise, the primary user would be expected to have a greater signal magnitude on the primary microphone.

Figure 4:
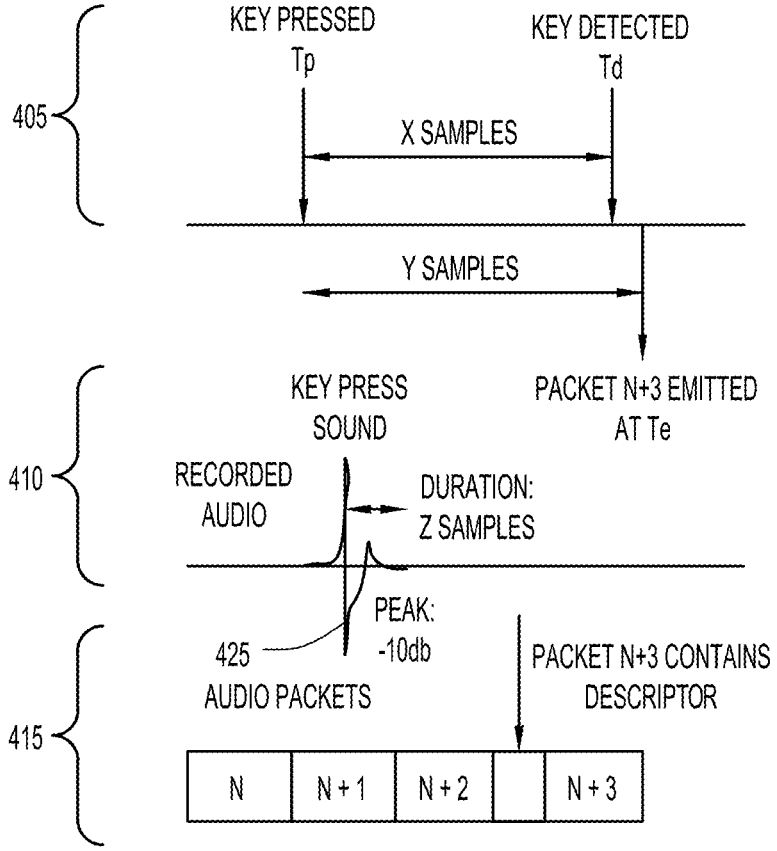
FIG. 4 is an illustration of a first process for generating an audio feature descriptor to provide distributed suppression or enhancement of audio features, according to an example embodiment.

With reference now made to FIG. 4, depicted therein are two timelines 405 and 410. Also illustrated is a series 415 of packets transmitting data associated with the events illustrated in timelines 405 and 410. Timeline 405 represents system events recorded at a transmitting device, such as transmitting device 105 of FIG. 1. Timeline 410 illustrates audio signals detected by a microphone of a transmitting device, such as microphones 120 of transmitting device 105 of FIG. 1. The packets of series 415 represent the corresponding packets formed and transmitted by a packetizer, such as packetizer 126 of FIG. 1. At time Tp a user presses a key causing a click sound. The key press sound, as illustrated through audio signal data 425, is encoded and packetized into packets N+1 and N+2. The key press sound is also recorded by the audio feature detector.

A system event reports at time Td that a key was pressed. The audio feature detector is aware that there is a latency of X samples between a key press and the associated system event (e.g., a key debounce event). In response to this system event, the audio feature detector initiates analysis of audio signal data 425. The analysis may begin at or near a location in the audio signal that is X samples prior to the associated system event. Accordingly, the analysis will take place at a portion of the audio signal having a recording depth matching or exceeding the known latency for the associated system event. In other words, temporal or timing data associated with the system event may be used to locate the associated audio feature. In response to this analysis, a key press sound is found at or near Td−X samples having a start time of Tp and a length of Z samples, i.e., audio data 425 is detected by the audio feature detector. The audio feature detector also records a peak magnitude M of 10 dB above the background noise level. The audio feature detector further determines that a portion or all of the detected key click sound was already encoded. Accordingly, an audio feature descriptor is included in packet N+3. Packet N+3 will be transmitted at a time Te, which is Y samples after time Tp. Therefore, the audio feature descriptor may identify the key click as starting at time offset −Y (i.e., Tp−Te), having a duration of Z samples, and magnitude M of 10 dB. By including this information into an audio feature descriptor, the receiving device can locate and suppress or enhance the corresponding audio feature as prescribed.

Figure 5:
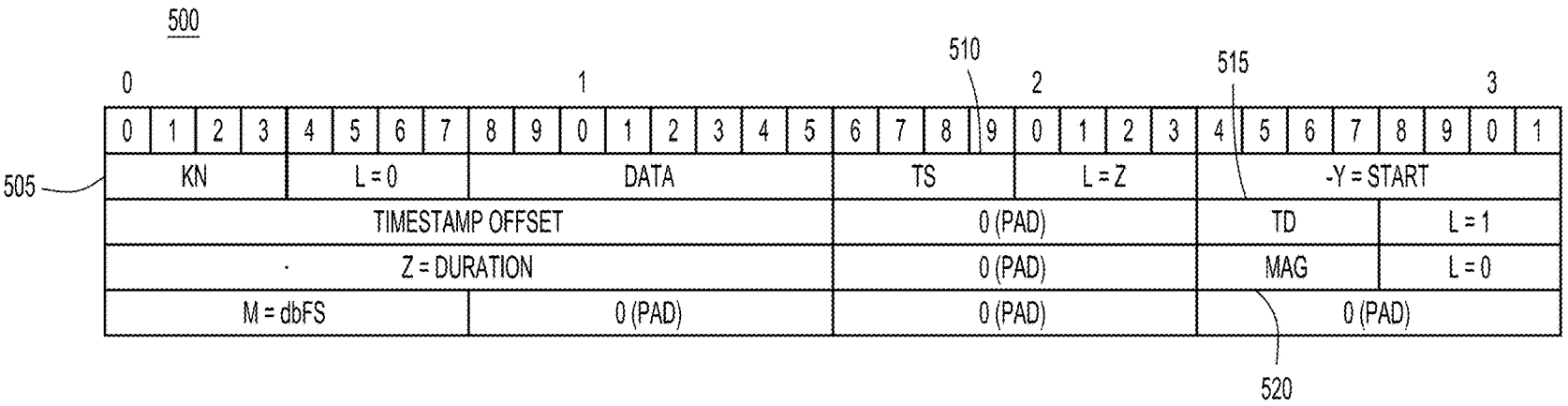
FIG. 5 is an illustration of a first Real-time Transport Protocol header extension that includes an audio feature descriptor used to provide distributed suppression or enhancement of audio features, according to an example embodiment.

With reference made to FIG. 5, depicted therein is an example audio feature descriptor that may be used in conjunction with the information determined above with reference to FIG. 4. Specifically, FIG. 5 illustrates a RTP header extension 500 that may identify an audio feature based upon the type of audio feature, the start time of the audio feature, the duration of the audio feature, and the magnitude of the audio feature. Specifically, field 505 of RTP header extension 500 identifies the audio descriptor as being a "Key Noise" or "KN" audio descriptor. Field 510 indicates the start time of the key noise, which using the example of FIG. 4 would be −Y samples, or Y samples prior to the generation of RTP extension header 500. Field 515 indicates the duration of the key noise, which using the example of FIG. 4 would be Z samples. Finally, field 520 indicates the magnitude M of the key noise, which according to the example of FIG. 4 would be 10 dB above the background noise level. Based on this information, a receiving device may enhance or suppress the identified audio feature, as will be described in detail with reference to FIG. 6.

Figure 6:
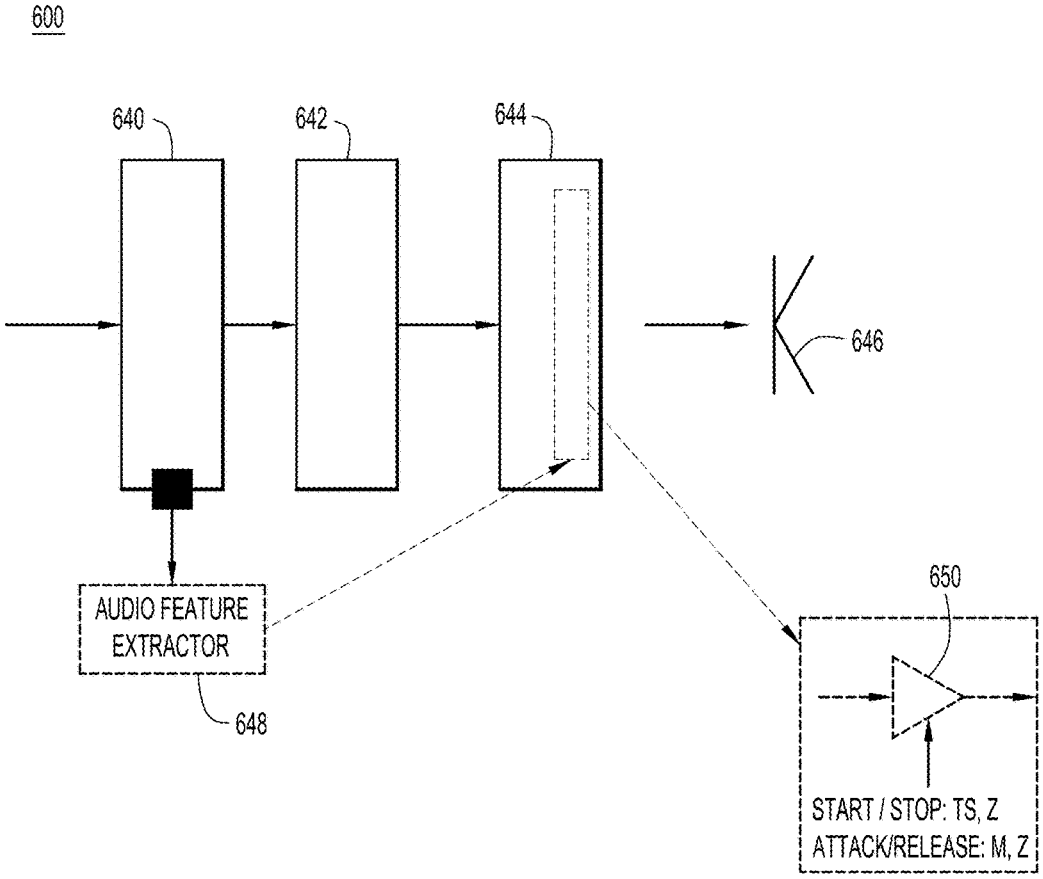
FIG. 6 is an illustration of a first method of using an audio feature descriptor to provide distributed suppression or enhancement of audio features, according to an example embodiment.

Illustrated in FIG. 6 are a jitter buffer 640, an audio decoder 642, an audio receive processing unit 644, speaker 646, and an audio feature extractor 648 of a receiving device 600, which may be analogous to receiving device 110 of FIG. 1. Receiving device 600 parses an incoming packet that contains an audio descriptor, such as packet N+3 of FIG. 4 that includes RTP extension header 500 of FIG. 5. Audio feature extractor 648 extracts the audio feature descriptor. Based on the content of the audio feature descriptor, audio feature extractor 648 determines that a "Key Noise" audio feature is located at −Y samples from the audio data contained in packet N+3, that the audio feature has a duration of Z samples, and a magnitude M of 10 dB above the background noise level. Based on this information, audio feature extractor 648 determines if the audio feature is actionable and has not been played out. Accordingly, audio feature extractor 648 discards the audio feature or else directs audio receive processing unit 644 to suppress the audio feature meeting the description contained in the audio feature descriptor. According to one example embodiment, an attenuator 650 located in receive audio processing unit 644 is configured to attenuate samples in the range starting at −Y samples for a duration of Z samples and to a depth derived from 10 dB.

Figure 7:
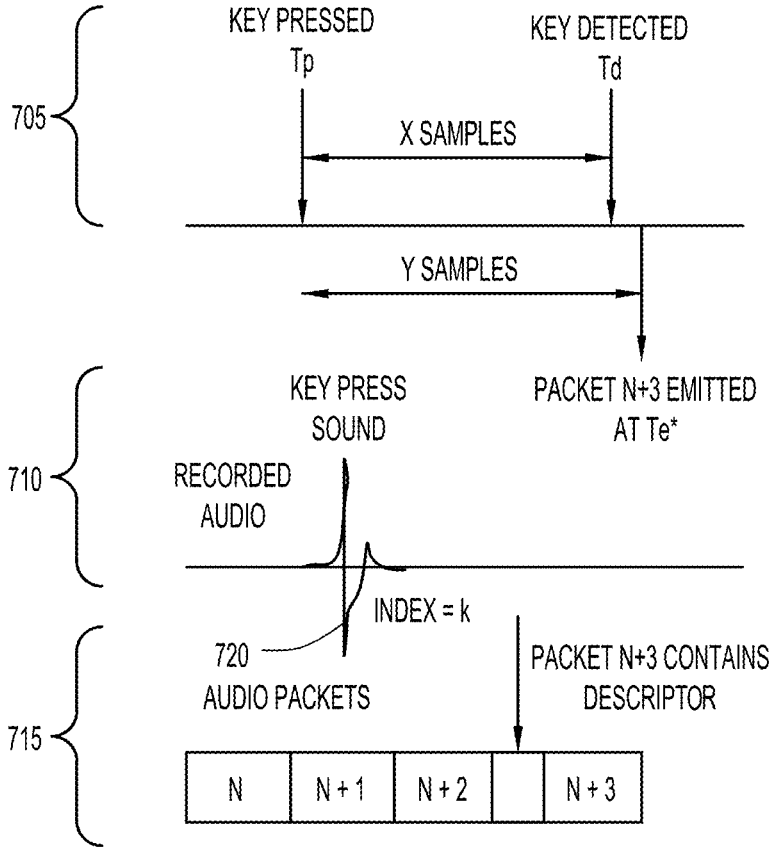
FIG. 7 is an illustration of a second process for generating an audio feature descriptor to provide distributed suppression or enhancement of audio features, according to an example embodiment.

With reference now made to FIG. 7, depicted therein are two timelines 705 and 710. Also illustrated is a series 715 of packets transmitting data associated with the events illustrated in timelines 705 and 710. FIG. 7 is similar to FIG. 4, but differs in that the audio feature descriptor generated by the transmitting device is defined differently than through the use of a start time, duration, and magnitude of the audio feature. Instead, the receiving device and the transmitting device, such as receiving device 105 and transmitting device 110 of FIG. 1, may be encoded with predetermined audio features that are to be suppressed and/or enhanced. For example, based on the characteristics of the transmitting device, the audio signal form of predetermined audio features may be known. Specifically, a key click noise as recorded by a certain type of transmitting device may be known to have an audio signal of a predetermined form. Other types of audio features may have similarly known audio signals of predetermined form. These predetermined forms may be stored in the memories of the transmitting and receiving devices, as may executable instructions for predetermined methods for suppressing or enhancing respective audio features. Accordingly, when an audio feature descriptor is created for one of these predetermined audio features, the information included in the audio feature descriptor may indicate the type of predetermined audio features and its starting point. Other information, such as a duration and/or magnitude of the audio feature may already be known as part of the predetermined form of the audio feature, and therefore, this information may not be included in the audio feature descriptor. Furthermore, these predetermined audio features may be compiled in a "codebook" such that the audio feature descriptor need only identify an index or location in the codebook for the predetermined audio features. The codebook may be stored in the memory of the transmitting device and/or the receiving device. Accordingly, the codebook and associated processing may be incorporated into resources associated with audio encoder 124 and audio decoder 142 such that the audio feature is adequately reproduced in the receiving device 110. This reproduced audio signal may then be used to suppress, discard and/or enhance the corresponding audio feature in the audio signal.

The codebook of audio feature descriptors may categorize audio features into types of audio features, such as audio features associated with system events, audio features associated with different types of background noise, and others. An audio feature may be determined to be a particular category of audio feature by analyzing the characteristics of an audio signal. For example, frequency domain characteristics of an audio signal may be used to identify one or more portions of an audio signal as including a wind noise audio feature. According to other examples, peak and average values in the time domain may be used to identify "key click" audio features in an audio signal. Because the characteristics of these different types of audio features are known, by providing the category of the audio feature through, for example, a codebook index value, the receiving device may be provided with sufficient information to discard, suppress and/or enhance the audio feature as prescribed. Specifically, the receiving device may locate the codebook entry indicated in the codebook index value received in the audio feature descriptor. Included in the codebook may be an indication of type (i.e., category) of the audio feature, as well as executable instructions for suppressing or enhancing the indicated audio feature. The receiving device may then execute the instructions to suppress or enhance the indicated audio feature.

Similar to FIG. 4, at time Tp a user presses a key causing a click sound. The key press sound, as illustrated through audio signal data 720 is encoded and packetized into packets N+1 and N+2. The key press sound is also recorded by the audio feature detector. A system event reports at time Td that a key was pressed. The audio feature detector is aware that there is a latency of X samples between a key press and the associated system event (i.e., a key deb ounce event). In response to this system event, the audio feature detector initiates analysis of audio signal data 720. Based on this analysis, a key press sound is found at or near time Td−X. The key click event and vector quantization methods may be used to search a codebook for an entry matching the sound detected starting at time Td−X. The audio feature detector further determines that a portion or all of the detected key click sound was already encoded. Accordingly, an audio feature descriptor is included in packet N+3. Packet N+3 will be transmitted at a time Te, which is Y samples after time Tp. Therefore, the audio feature descriptor may identify the key click as starting at time offset −Y (i.e., Tp−Te), and the corresponding the codebook entry as determined by the audio feature extractor.

Figure 8:
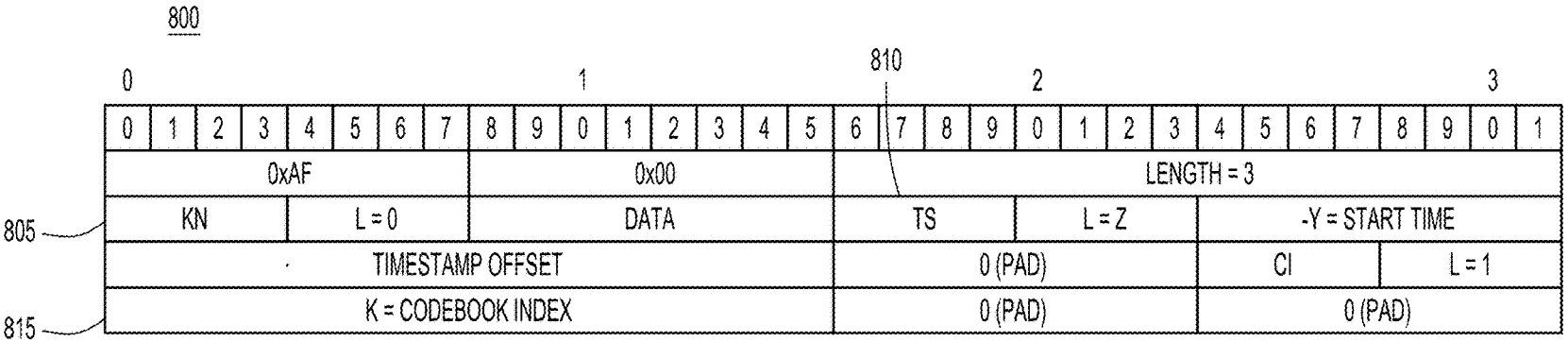
FIG. 8 is an illustration of a second Real-time Transport Protocol header extension that includes an audio feature descriptor used to provide distributed suppression or enhancement of audio features, according to an example embodiment.

With reference made to FIG. 8, depicted therein is an example audio feature descriptor that may be used in conjunction with the information determined above with reference to FIG. 7. Specifically, FIG. 8 illustrates a RTP header extension 800 that may identify an audio feature based upon the start time of the audio feature, and the "codebook" entry associated with the audio feature. Specifically, field 805 of RTP header extension 800 identifies the audio descriptor as being a "Key Noise" or "KN" audio descriptor. Field 810 indicates the start time of the key noise, which using the example of FIG. 7 would be −Y samples, or Y samples prior to the generation of RTP extension header 800. Field 815 indicates the codebook entry associated with the predetermined audio descriptor identified by audio feature descriptor 800. According to the example of FIG. 8, a codebook index value of "k" is associated with the audio feature identified by audio feature descriptor 800. Based on this information, a receiving device may enhance or suppress the identified audio feature, as will be described in detail with reference to FIG. 9.

Figure 9:
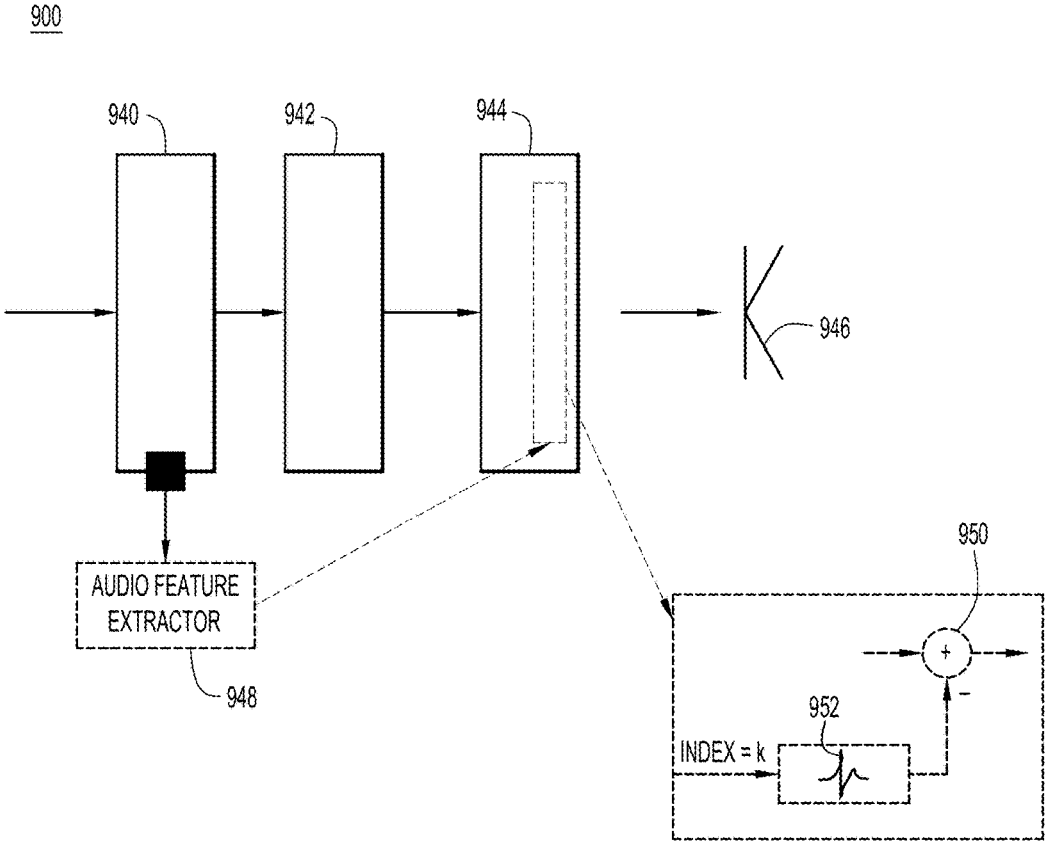
FIG. 9 is an illustration of a second method of using an audio feature descriptor to provide distributed suppression or enhancement of audio features, according to an example embodiment.

Illustrated in FIG. 9 are a jitter buffer 940, an audio decoder 942, an audio receive processing unit 944, speaker 946, and an audio feature extractor 948 of a receiving device 900, which may be analogous to receiving device 110 of FIG. 1. Receiving device 900 parses an incoming packet that contains an audio descriptor, such as packet N+3 of FIG. 7 that includes RTP extension header 800 of FIG. 8. Audio feature extractor 948 extracts the audio feature descriptor. Based on the content of the audio feature descriptor, audio feature extractor 948 determines that a "Key Noise" audio feature is located at −Y samples from the audio data contained in packet N+3. Audio feature extractor 948 also determines that a codebook entry with an index value of "k" corresponds to the audio feature identified in the audio feature descriptor. Based on this information, audio feature extractor 948 determines if the audio feature is actionable (i.e., can be discarded, suppressed, and/or enhanced) and has not been played out. Accordingly, audio feature extractor 948 discards the audio feature or else directs audio receive processing unit 944 to suppress an audio feature meeting the description contained in the audio feature description. Accordingly, a waveform canceller 950 located in receive audio processing module 944 is configured to subtract a signal vector 952 derived from a codebook entry indexed by "k." In other words, included in the codebook entry indexed by "k" are instructions that a signal vector 952 should be subtracted from the audio signal in order to eliminate the audio feature corresponding to the codebook entry indexed by "k." Waveform canceller 950 executes these instructions.

Figure 10:
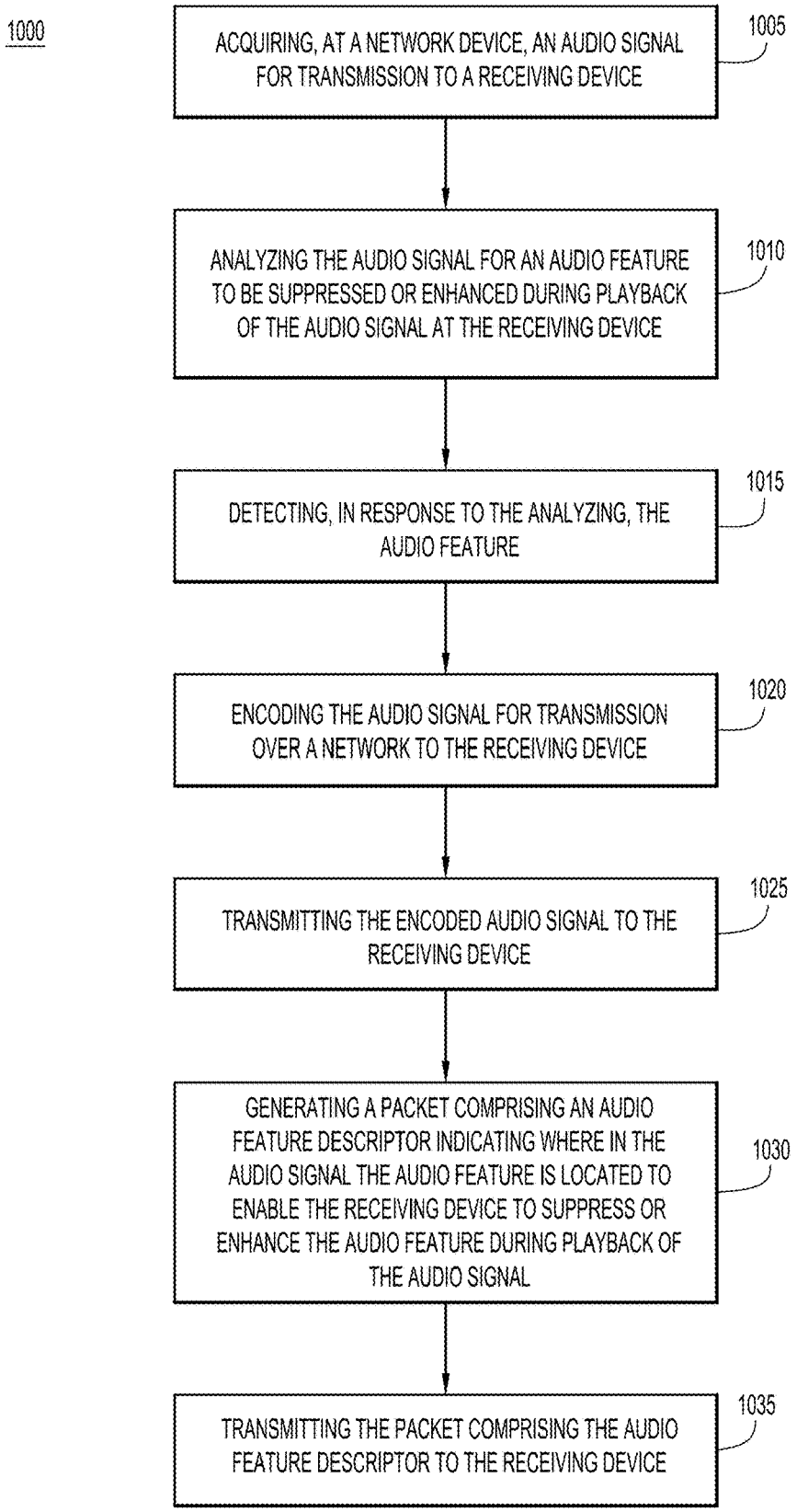
FIG. 10 is a flowchart illustrating a process for providing distributed suppression or enhancement of audio features from the perspective of a transmitting device, according to an example embodiment.

With reference now made to FIG. 10, depicted therein is a flowchart 1000 illustrating a process for distributed suppression and/or enhancement of audio features. Specifically, flowchart 1000 illustrates a process from the perspective of a transmitting device, such as transmitting device 105 of FIG. 1. The process begins in operation 1005 wherein an audio signal is acquired at a network device. The audio signal is intended for transmission to a receiving device. The network device may be embodied in a transmitting device, like transmitting device 105 of FIG. 1, and the receiving device may be embodied in a receiving device like device 110 of FIG. 1. Similarly, the audio signal may be a VoIP or online collaborative session audio signal.

In operation 1010, the audio signal is analyzed for an audio feature to be suppressed or enhanced during playback of the audio signal at the receiving device. For example, the audio feature may be a transient sound to be suppressed during playback, as described above with reference to FIG. 1. Furthermore, the analysis may take place as described above with reference to FIGS. 2 and 3.

In operation 1015, the audio signal is detected in response to the analyzing of operation 1010. In operation 1020, the audio signal is encoded for transmission over a network to the receiving device, and transmitted to the receiving device in operation 1025. According to some example embodiments, audio feature suppression or enhancement will take place at the network device that analyzes the audio signal. When this takes place, the processing to be described below in conjunction with reference numerals 1030 and 1035 may be omitted. On the other hand, the processing associated with reference numeral 1030 may still be carried out so that further enhancement or suppression of the detected audio feature may also be performed at the receiving device.

In operation 1030, a packet is generated comprising an audio feature descriptor indicating where in the audio signal the audio feature is located. This packet enables the receiving device to suppress or enhance the audio feature during playback of the audio signal. The packet may comprise an audio feature descriptor including the information as described in FIGS. 5 and/or 8 arranged in the form of an RTP header extension. Finally, in operation 1035, the packet comprising the audio feature descriptor is transmitted to the receiving device.

Figure 11:
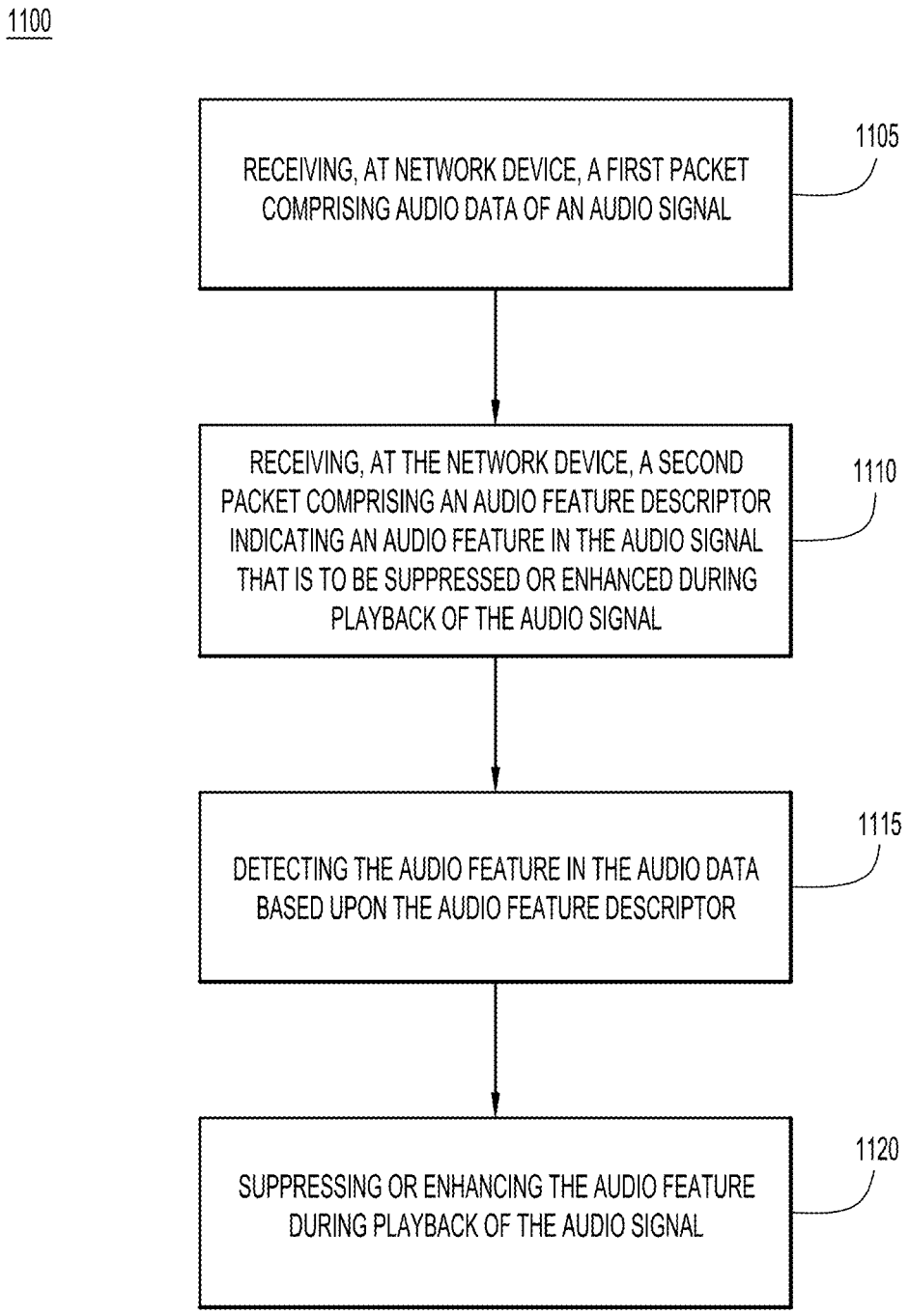
FIG. 11 is a flowchart illustrating a process for providing distributed suppression or enhancement of audio features from the perspective of a receiving device, according to an example embodiment.

With reference now made to FIG. 11, depicted therein is a flowchart 1100 illustrating a process for distributed suppression and/or enhancement of audio features. Specifically, flowchart 1100 illustrates a process from the perspective of a receiving device, such as receiving device 110 of FIG. 1. The process begins in operation 1105 where a first packet comprising audio data of an audio signal is received at a network device. The first packet may be one packet of a packet stream encoded with compressed audio data associated with the audio signal. The network device may be embodied in a receiving device, such as receiving device 110 of FIG. 1.

In operation 1110, a second packet is received at the receiving device. The second packet comprises an audio feature descriptor indicating an audio feature in the audio signal that is to be suppressed or enhanced during playback of the audio signal. The audio feature descriptor may comprise an audio feature descriptor including the information as described in FIGS. 5 and/or 8 arranged in the form of an RTP header extension.

In operation 1115, the audio feature is located in the audio data based upon the audio feature descriptor. For example, the audio feature may be located according to the techniques described above with reference to FIGS. 6 and/or 9. Accordingly, the audio feature may be located in audio data received in the first packet, audio data received in the second packet, audio data received in both the first packet and the second packet, and/or audio data received in another packet different from the first packet and the second packet. In other words, the audio feature may be located in the packets of a packet stream associated with the audio signal. Finally, in operation 1120, the audio feature is suppressed or enhanced during playback of the audio signal. The audio feature may be suppressed or enhanced according to the techniques described above with reference to FIGS. 6 and/or 9.

Figure 12:
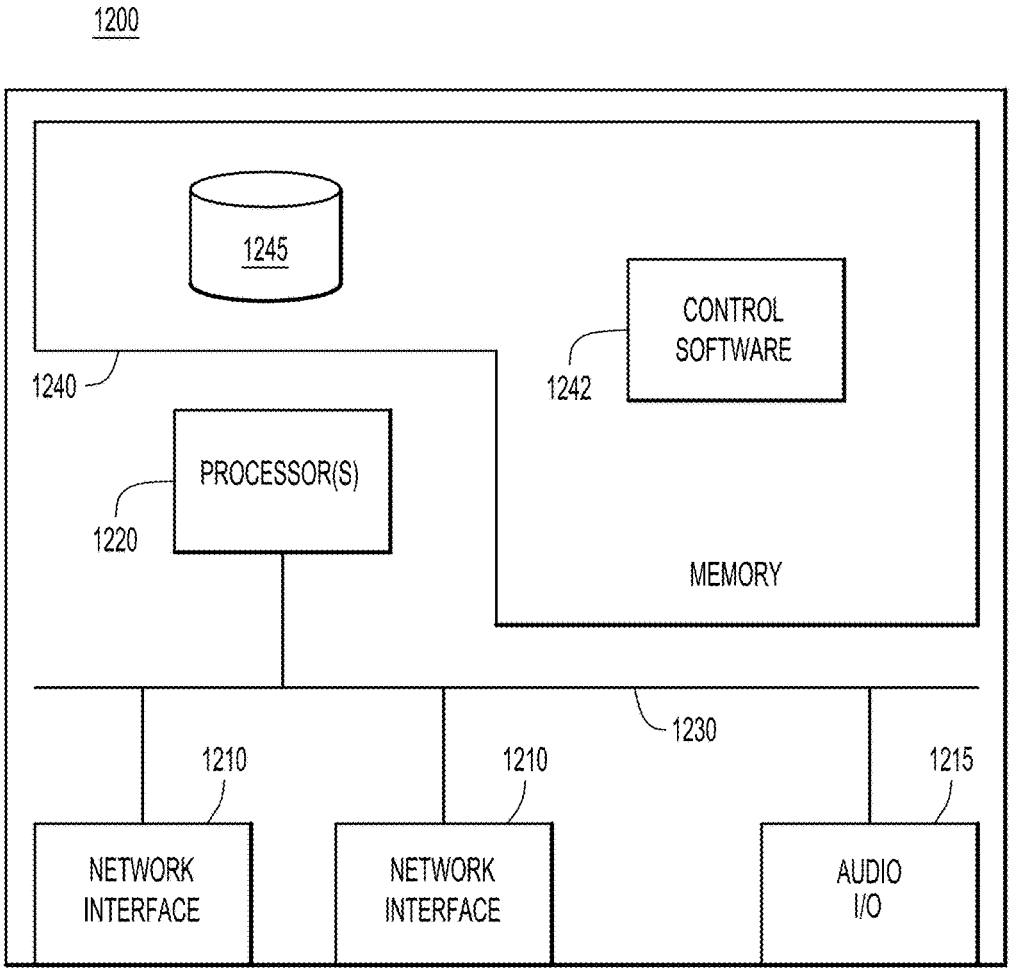
FIG. 12 is a block diagram of a device configured to provide distributed suppression or enhancement of audio features, according to an example embodiment.

With reference to FIG. 12, depicted therein is a device 1200 configured to perform the techniques described herein. For example, device 1200 may be a network connected device configured to perform as one or both of transmitting device 105 and/or receiving device 110 of FIG. 1. Device 1200 includes network interfaces (e.g., network ports) 1210 which may be used to receive and send packets over a network. The network interfaces 1210 may be included as part of a network interface unit (e.g., a network interface card). Accordingly, network interfaces 1210 may be embodied as wired interfaces, wireless interfaces, optical interfaces, electrical interfaces, or a combination thereof.

Device 1200 also includes audio input/output devices 1215. Audio input/output devices 1215 may serve to receive or playback audio signals. Accordingly, audio input/output devices 1215 may be embodied as one or more of microphones or speakers.

One or more processors 1220 are provided to coordinate and control device 1200. The processor 1220 is, for example, one or more microprocessors or microcontrollers, and it communicates with the network interfaces 1210 and audio input/output devices 1215 via bus 1230. Memory 1240 stores software instructions 1242 which may be executed by the processor 1220. For example, control software 1242 for device 1200 includes instructions for performing the techniques described above with reference to FIGS. 1-11. In other words, memory 1240 includes instructions for device 1200 to carry out the operations described above in connection with FIGS. 1-11. For example, memory 1240 may include instructions that allow processors 1220 to perform the actions associated with one or more of transmitter audio processing unit 122, audio encoder 124, packetizer 126, audio feature extractor 130, jitter buffer 140, audio decoder 142, receiver audio processing unit 144, and/or audio feature extractor 148, as described above with reference to FIG. 1. According to other example embodiments, processors 1220 may have hardware instructions that allow processors 1220 to perform the actions associated with one or more of transmitter audio processing unit 122, audio encoder 124, packetizer 126, audio feature extractor 130, jitter buffer 140, audio decoder 142, receiver audio processing unit 144, and/or audio feature extractor 148, as described above with reference to FIG. 1. Memory 1240 may also store data 1245 (e.g., a "codebook") of audio signals as discussed above with reference to FIGS. 7-9. This data may be stored in a database in memory 1240, and control software 1242 may allow the processor 1220 to access the data.

Memory 1240 may include read only memory (ROM), random access memory (RAM), magnetic disk storage media devices, optical storage media devices, flash memory devices, electrical, optical or other physical/tangible (e.g., non-transitory) memory storage devices. Thus, in general, the memory 1240 may be or include one or more tangible (non-transitory) computer readable storage media (e.g., a memory device) encoded with software comprising computer executable instructions. When the instructions of the control software 1242 are executed (by the processor 1220), the processor is operable to perform the operations described herein in connection with FIGS. 1-11.

In summary, provided herein are methods of providing distributed suppression or enhancement of audio features. A first method includes acquiring, at a network device, an audio signal for transmission to a receiving device. The audio signal is analyzed for an audio feature to be suppressed or enhanced during playback of the audio signal at the receiving device. The audio feature is detected based on the analyzing. The audio signal is encoded for transmission over a network to the receiving device, and the encoded audio signal is transmitted to the receiving device. The method further includes generating a packet comprising an audio feature descriptor indicating where in the audio signal the audio feature is located to enable the receiving device to suppress or enhance the audio feature during playback of the audio signal. The packet comprising the audio feature descriptor is also transmitted to the receiving device.

A second method involves providing distributed suppression or enhancement of audio features includes receiving, at a network device, a first packet comprising audio data of an audio signal. A second packet comprising an audio feature descriptor indicating an audio feature in the audio signal that is to be suppressed or enhanced during playback of the audio signal is also received at the network device. Based upon the audio feature descriptor, the audio feature is located in the audio data. The audio feature is suppressed or enhanced during playback of the audio signal.

Also provided herein is an apparatus configured to provide distributed suppression or enhancement of audio features. The apparatus includes processors and network interfaces. The processors of a first apparatus are configured to acquire an audio signal for transmission to a receiving device. The processor is configured to analyze the audio signal for an audio feature to be suppressed or enhanced during playback of the audio signal at the receiving device. The processor detects the audio feature based on the analyzing. The processor encodes the audio signal for transmission over a network to the receiving device, and the processor transmits the encoded audio signal to the receiving device via the network interface. The processor is further configured to generate a packet comprising an audio feature descriptor indicating where in the audio signal the audio feature is located to enable the receiving device to suppress or enhance the audio feature during playback of the audio signal. The processor transmits the packet comprising the audio feature descriptor to the receiving device via the network interface.

A second apparatus includes a processor configured to receive, via a network interface, a first packet comprising audio data of an audio signal. The processor also receives, via the network interface, a second packet comprising an audio feature descriptor indicating an audio feature in the audio signal that is to be suppressed or enhanced during playback of the audio signal. Based upon the audio feature descriptor, the processor locates the audio feature in the audio data. The processor is further configured to suppress or enhance the audio feature during playback of the audio signal.

In addition, one or more non-transitory computer readable storage media are provided encoded with software comprising computer executable instructions, and when the software is executed, it is operable to perform operations for distributed suppression or enhancement of audio features, including acquiring an audio signal for transmission to a receiving device, analyzing the audio signal for an audio feature to be suppressed or enhanced during playback of the audio signal at the receiving device, and detecting the audio feature based on the analyzing. The instructions also cause the audio signal to be encoded for transmission over a network to the receiving device. The instructions further cause the generation of a packet comprising an audio feature descriptor indicating where in the audio signal the audio feature is located to enable the receiving device to suppress or enhance the audio feature during playback of the audio signal, and cause the transmission of the packet comprising the audio feature descriptor to the receiving device.

In another form, instructions on the non-transitory computer readable storage media, when executed, cause the receipt of a first packet via a network. The first packet comprises audio data of an audio signal. The instructions cause a second packet to be received via the network, wherein the second packet includes an audio feature descriptor indicating an audio feature in the audio signal that is to be suppressed or enhanced during playback of the audio signal. Based upon the audio feature descriptor, the instructions cause the audio feature to be located in the audio data. The instructions further cause the suppression or enhancement of the audio feature during playback of the audio signal.

These techniques enhance the audio experience at the receiving side by identifying and suppressing or enhancing audio features, such as transient noises. Endpoints that use the techniques described herein improve user experiences. Specifically, audio features generated in a device may be identified jointly by signal analysis and system events. The identified audio features may be suppressed or enhanced locally or across the network at receiving devices as necessary. The distributed noise suppression and enhancement techniques described herein accommodate audio feature detection of varying latencies and mechanisms. The techniques described herein improve voice quality for endpoints and conferencing products. These techniques improve over conventional noise reduction and enhancement techniques which are not distributed, may require significant processing resources, and may not make use of system events to help identify transients.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

What is claimed is:

1. A method comprising:

acquiring, at a network device, an audio signal for transmission to a receiving device;

providing the audio signal to an audio encoder of the network device;

providing the audio signal to an audio feature detector of the network device;

receiving, at the audio feature detector, an indication of a system event of the network device;

analyzing the audio signal, at the audio feature detector, for an audio feature associated with the system event to be suppressed during playback of the audio signal at the receiving device;

detecting, based on the analyzing and the indication, the audio feature;

generating audio descriptor data indicating where in the audio signal the audio feature is located;

encoding, at the audio encoder, the audio signal for transmission over a network to the receiving device;

transmitting the encoded audio signal to the receiving device;

generating a packet comprising the audio feature descriptor data to enable the receiving device to suppress the audio feature during playback of the audio signal; and transmitting the packet comprising the audio feature descriptor data to the receiving device.

2. The method of claim 1, wherein the audio feature descriptor data indicates one or more of a temporal location of the audio feature in the audio signal and/or a description of a type of audio feature.

3. The method of claim 2, wherein the type of audio feature comprises a codebook value for the audio feature.

4. The method of claim 1, wherein the packet comprises a Real-time Transport Protocol header, and wherein the Real-time Transport Protocol header includes the audio feature descriptor data.

5. The method of claim 1, where the packet comprises audio data of the audio signal subsequent to the audio feature in the audio signal, and the audio feature descriptor data is arranged in a header of the audio packet.

6. The method of claim 1, wherein the indication of the system event of the network device comprises temporal data; and wherein analyzing the audio signal comprises correlating audio data of the audio signal with the temporal data.

7. The method of claim 6, wherein the temporal data comprises a known latency between the system event and the audio feature, and wherein analyzing the audio signal comprises searching for the audio feature based upon the known latency.

8. The method of claim 7, wherein analyzing the audio signal comprises analyzing a portion of the audio signal having a recording depth matching or exceeding the known latency.

9. A method comprising:

receiving, at a network device, a first packet comprising audio data of an audio signal, wherein the audio signal comprises an audio feature of a system event of a network device that recorded the audio signal;

receiving, at the network device, a second packet comprising audio feature descriptor data indicating the audio feature in the audio signal that is to be suppressed during playback of the audio signal, wherein the audio feature descriptor data comprises a codebook value corresponding to a type of the audio feature;

locating the audio feature in the audio data based upon the audio feature descriptor data;

retrieving from a codebook a codebook entry corresponding to the codebook value; and suppressing the audio feature during playback of the audio signal utilizing audio processing indicated in the codebook entry.

10. The method of claim 9, wherein the second packet comprises a Real-time Transport Protocol header, wherein the Real-time Transport Protocol header comprises the audio feature descriptor data.

11. The method of claim 9, wherein the second packet comprises audio data of the audio signal subsequent to the audio feature in the audio signal, and wherein the audio feature descriptor data is arranged within a header of the second packet.

12. The method of claim 9, further comprising:

extracting a temporal location of the audio feature in the audio signal from the audio feature descriptor data; and locating the audio feature in the audio signal based on the temporal location.

13. An apparatus comprising:

a network interface configured to send and receive network flows over a network; and a processor configured to:

acquire an audio signal for transmission to a receiving device;

receive an indication of a system event of the apparatus;

analyze the audio signal for an audio feature associated with the system event to be suppressed during playback of the audio signal at the receiving device;

detect, based on the analyzing and the indication, the audio feature;

generate audio descriptor data indicating where in the audio signal the audio feature is located;

encode the audio signal for transmission over a network to the receiving device;

transmit the encoded audio signal to the receiving device;

generate a packet comprising the audio feature descriptor data to enable the receiving device to suppress the audio feature during playback of the audio signal;

transmit the packet comprising the audio feature descriptor data to the receiving device.

14. The apparatus of claim 13, wherein the audio feature descriptor data indicates one or more of a temporal location of the audio feature in the audio signal and/or a description of a type of audio feature.

15. The apparatus of claim 13, wherein the packet comprises a Real-time Transport Protocol header, and wherein the Real-time Transport Protocol header includes the audio feature descriptor data.

16. One or more non-transitory computer readable storage media encoded with software comprising computer executable instructions and when the software is executed operable to cause a processor to:

acquire an audio signal for transmission to a receiving device;

receive an indication of a system event of a device that recorded the audio signal;

analyze the audio signal for an audio feature associated with the system event to be suppressed during playback of the audio signal at the receiving device;

detect, based on the analyzing, the audio feature;

generate audio descriptor data indicating where in the audio signal the audio feature is located;

encode the audio signal for transmission over a network to the receiving device;

transmit the encoded audio signal to the receiving device;

generate a packet comprising the audio feature descriptor data to enable the receiving device to suppress the audio feature during playback of the audio signal;

transmit the packet comprising the audio feature descriptor data to the receiving device.

17. The non-transitory computer readable storage media of claim 16, wherein the audio feature descriptor data indicates one or more of a temporal location of the audio feature in the audio signal and/or a description of a type of audio feature.

18. The non-transitory computer readable storage media of claim 16, wherein the packet comprises a Real-time Transport Protocol header, and wherein the Real-time Transport Protocol header includes the audio feature descriptor data.

19. The apparatus of claim 14, wherein the type of audio feature comprises a codebook value for the audio feature.

20. The non-transitory computer readable storage media of claim 17, wherein the type of audio feature comprises a codebook value for the audio feature.

* * * * *